US006299519B1

(12) United States Patent
Easter et al.

(10) Patent No.: US 6,299,519 B1
(45) Date of Patent: Oct. 9, 2001

(54) APPARATUS AND METHOD FOR REMOVING A POLISHING PAD FROM A PLATEN

(75) Inventors: William G. Easter; John A. Maze, III; Frank Micelli, all of Orlando, FL (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/366,362

(22) Filed: Aug. 3, 1999

(51) Int. Cl.[7] ..... B24D 11/00
(52) U.S. Cl. ..... 451/526; 451/539
(58) Field of Search ..... 451/538, 539, 451/526, 529, 531, 5, 41

(56) References Cited

U.S. PATENT DOCUMENTS 3,267,623 * 8/1966 Block ..... 451/538
3,932,967 * 1/1976 Hanes ..... 451/45
4,274,232 * 6/1981 Wylde ..... 451/490
5,170,595 * 12/1992 Wiand ..... 451/538
5,377,455 * 1/1995 Lanzer ..... 451/5
5,836,810 * 11/1998 Asum ..... 451/526

FOREIGN PATENT DOCUMENTS 42 41 890 A1 * 6/1993 (DE) ..... 451/539
1321931 A * 7/1973 (GB) ..... B24D/17/00

* cited by examiner

*Primary Examiner*—Joseph J. Hail, III
*Assistant Examiner*—David B. Thomas

(57) ABSTRACT

An apparatus and method for removing a polishing pad from a platen during a CMP process is disclosed. The invention facilitates the removal of a polishing pad from a platen by providing a polishing pad having at least one protuberance portion extending from the main portion of the pad such that the polishing pad may be removed manually or with the assistance of a device by engaging the protuberance portion.

16 Claims, 5 Drawing Sheets

APPARATUS AND METHOD FOR REMOVING A POLISHING PAD FROM A PLATEN

CROSS REFERENCE TO RELATED APPLICATIONS (Not Applicable)

STATEMENT OF FEDERALLY SPONSORED RESEARCH OR DEVELOPMENT (Not Applicable)

BACKGROUND OF THE INVENTION

1. Technical Field

This invention relates generally to the field of semiconductor manufacturing. More particularly, the invention relates to devices and methods for removing polishing pads from the polishing platens of chemical mechanical planarization (CMP) machines.

2. Description of the Related Art

CMP is an abrasive process used to polish silicon wafers during semiconductor manufacturing. Polishing planarizes, or flattens, the surface of the wafer to very precise tolerances. A planarized wafer surface is essential for maintaining the precise photolithographic depth of focus required for integrated circuit chip fabrication.

CMP is typically performed using a machine having a platen, a polishing pad, a backing film, and a wafer carrier. The polishing pad resides on the platen, and a semiconductor wafer is pressed against the polishing pad. Backing film separates the wafer from the wafer carrier, which is used to hold the wafer in place during the CMP process. Once a wafer is mounted on a CMP device, a slurry consisting of liquid and small suspended particles, such as a colloidal silica suspended in a KOH solution, is applied at the interface of the pad and the wafer. The slurry uses mechanical and chemical processes to planarize the wafer.

During the CMP process, the polishing platen rotates. The wafer and the wafer carrier also rotate independent of the platen, causing the wafer to move through the slurry in a rotary fashion. As slurry flows over a wafer's surface, the suspended particles in the slurry mechanically abrade the surface and the liquid in the slurry chemically etches the abraded area. The pressure from the wafer carrier against the polishing pad provides the driving force for the process. In this manner, CMP removes materials from the high spots on the wafer while removing negligible amounts of material from the low spots on the wafer, resulting in a flattened, or planarized, wafer.

A critical component of the CMP process is the polishing pad. Polishing pads are typically made of polyurethane, and contain grooves or small perforations punched into the pads to help transport the slurry and facilitate polishing. The surface of the polishing pad contains asperites typically 1 to 10 micrometers in size that help transport and hold the slurry. With use, these asperites become flattened, resulting in a state called "glazing." A glazed pad reduces the efficiency of the CMP process because the pad cannot hold much polishing slurry, nor can it apply appropriate pressure to a wafer. Although a glazed pad can be rejuvenated, eventually all pads need to be replaced. Typically, pads require replacement after polishing just 1500 wafers, meaning that a pad's lifespan is approximately 50 hours at a polishing rate of 30 wafers per hour.

Conventionally, polishing pads are removed from platens manually, whereby an individual tears the pad off of the platen. This conventional method is unsatisfactory, however, because polishing pads are affixed to platens using a strong adhesive. Moreover, the conventional method cannot be performed by workers lacking the necessary physical strength to remove a polishing pad. The task can cause injury not only because of the force that is necessary to remove a polishing pad from a platen, but also because the task is ergonomically difficult. On average, approximately one hour is required to remove an old pad and replace it with a new one. Given this downtime, there is a great need for a device and an improved method for removing polishing pads from platens.

SUMMARY OF THE INVENTION

The invention provides an improved method of removing a polishing pad from a platen during a CMP process by providing a pad having at least one protuberance portion extending from a main portion of the pad. This protuberance portion can be used to hold the pad, and to gain leverage for removing the pad manually or with the assistance of a mechanical device. If the protuberance portion has at least one aperture or other engagement structure, leverage can also be gained by inserting a tool into the aperture or by connecting a tool to the engagement structure.

It is an object of the invention to facilitate the removal of a polishing pad from a platen by providing a polishing pad having at least one protuberance extending from the main portion of the pad, so that the polishing pad can be held and removed manually or with the assistance of a mechanical device by engaging the protuberance portion. It is a further object of the invention to provide an aperture or other engagement structure in the protuberance portion of the polishing pad in order to provide extra leverage during the polishing pad removal process. It is still another object of the invention to make the process of removing polishing pads from a platen more time efficient, thereby improving CMP processing times.

A polishing pad, according to the invention, comprises a main portion and at least one protuberance portion extending from the main portion. This protuberance portion can elevate above the main portion or extend beyond the edge of the main portion. The main portion and the protuberance portion can be formed integrally or attached to each other. The protuberance portion can have structure for engaging a removal tool, and this engagement structure may comprise at least one aperture.

A polishing pad removal system, in accordance with the invention, comprises an engagement structure for engaging a polishing pad and a pulling structure for pulling the engagement structure, thereby separating the polishing pad from the platen. The engagement structure can be a removal roller adapted to hold the polishing pad, and the pulling structure can be a, rotating device. The pulling structure and the engagement structure can be one device so that it is unnecessary to attach the engagement structure to the pulling device.

The polishing pad can have a main portion and a protuberance portion that engages a removal roller. Rotation of the removal roller by the rotating device causes the pad to separate from the platen. The removal roller can have a slot, and the at least one protuberance portion can be inserted into the slot prior to operating the rotating device. A chain can actuate the removal roller so that pulling the chain across the removal roller rotates the removal roller. The engagement structure can comprise a fastener having a plurality of holding devices and a plurality of split connectors that engage the holding devices. If the engagement structure is a removal roller, rotation of the removal roller can cause the split connectors to rotate the holding devices. Rotation of the removal roller can also pull together the holding devices so that they can hold the polishing pad.

According to the invention, a method of removing a polishing pad from a platen comprises the steps of providing a polishing pad having a main portion and at least one protuberance portion, attaching the protuberance portion to an engagement structure, the engagement structure being attached to a pulling structure, and activating the pulling structure, whereby the polishing pad is separated from the platen.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENT

Figure 1:
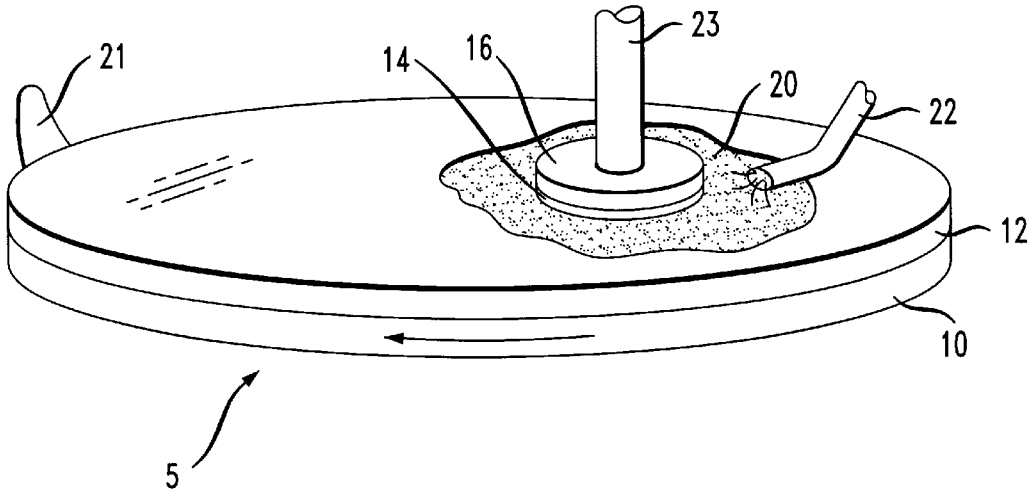
FIG. 1 depicts a CMP polisher according to the invention.

The present invention relates to a device and method for removing a polishing pad from a platen. In FIG. 1, a CMP device 5 according to the invention is depicted. A wafer 14 is shown affixed to a wafer carrier 16. According to conventional CMP processes, the wafer 14 is pressed by the wafer carrier 16 against a polishing pad 12, which has a protuberance portion 21. The polishing pad 12 is attachable to a platen 10. The platen 10 and the polishing pad 12 rotate. The wafer carrier 16 is rotated by a spindle 23, causing the wafer 16 to contact the polishing pad 12. A slurry supply system 22 provides polishing slurry 20 to the polishing pad 12.

Figure 2A:
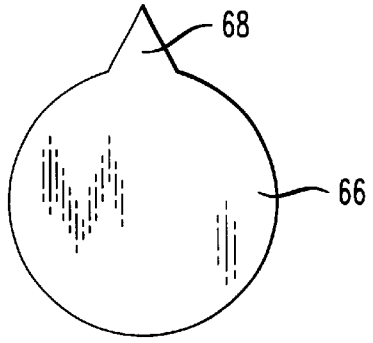
FIG. 2*a* is a top plan view of a polishing pad having a main portion and a protuberance portion.
Figure 2B:
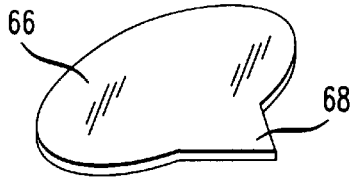
FIG. 2*b* is a perspective view of a polishing pad having a main portion and a protuberance portion.

The polishing pad 12 can be composed of any substance suitable for polishing a semiconductor wafer, and is typically composed at least partially of polyurethane. The pad is usually planar and relatively circular. Consequently, it is quite difficult to remove a pad from a platen because no manner of gripping the pad or achieving leverage is provided. The invention solves this problem by providing a polishing pad having at least one protuberance portion. The protuberance portion is not attached to a platen, and may extend beyond the edge or circumference of the platen or reside above the surface of the platen. Referring now to FIGS. 2*a* and 2*b*, there is shown a polishing pad having a main portion 66 and a protuberance portion 68. The main portion 66 may be any shape and size that can be affixed to or extend from a platen used in semiconductor wafer manufacturing, while the protuberance portion 68 that extends above or beyond the circumference or edge of the main portion 66 may be any shape and size that can be held or used to gain leverage for removing a polishing pad.

Methods of manufacturing polishing pads are known in the art, and the polishing pad 12 of the present invention may be manufactured in accordance with those methods, and specifically may be manufactured from a single mold so that the main portion 66 and the protuberance portion 68 do not need to be joined. If the pad is made from a single mold, the protuberance portion 68 of the pad can be composed at least partially of a substance that will strengthen the protuberance portion 68, such as carbon filler.

A pad according to the invention may also be made by gluing, melting or otherwise adhering the protuberance portion 68 to a previously manufactured main portion 66 of the polishing pad 12. Similarly, a protuberance portion may be fastened, hooked, buttoned, or otherwise mechanically attached to the main portion 66. In the preferred embodiment, the polishing pad 12 is manufactured from a single mold as an integral piece.

There are several ways in which this pad can be used to improve the process of removing a polishing pad from a platen. Most simply, the protuberance portion 68 is manually grabbed and used to gain leverage for pulling the polishing pad 12 off of the platen 10. Additionally, if the protuberance portion 68 is designed with at least one aperture or other engagement structure, a tool may be connected to the protuberance portion 68 to gain additional leverage during the removal process.

Figure 3A:
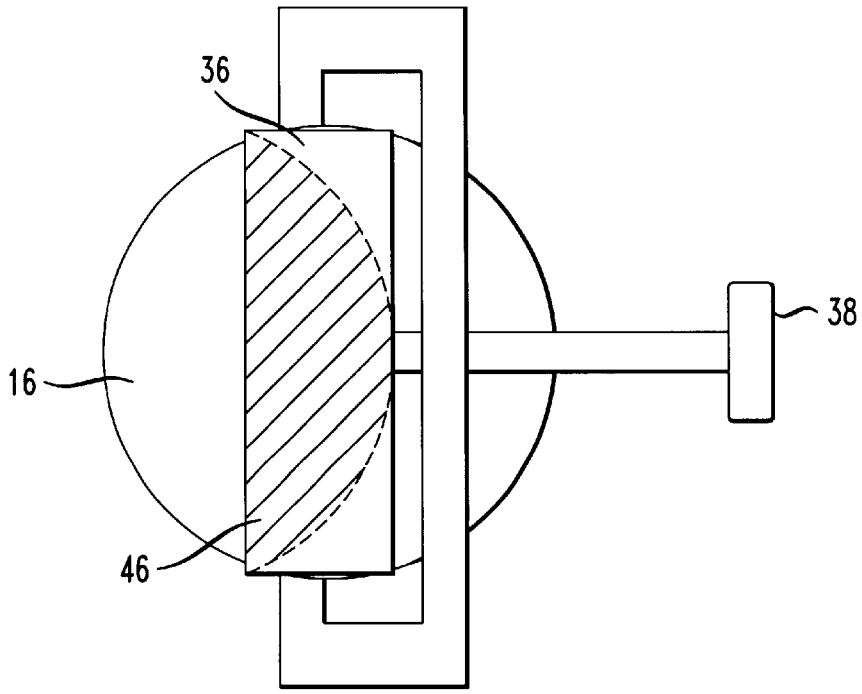
FIG. 3*a* is a top plan view of a system for removing a polishing pad from a platen.
Figure 3B:
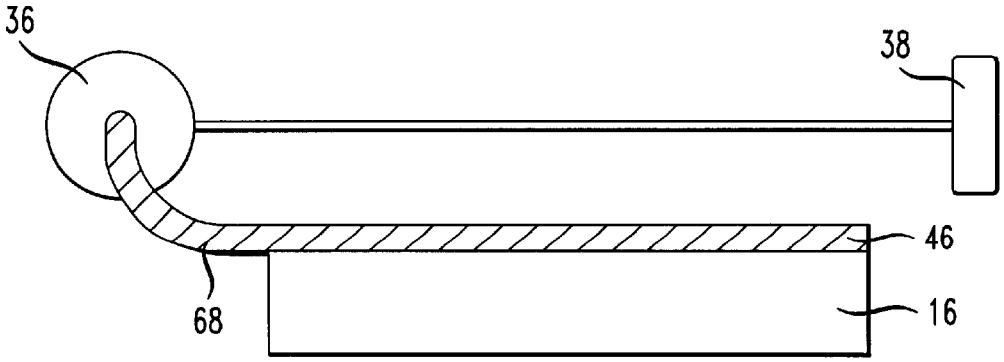
FIG. 3*b* is a schematic of a system for removing a polishing pad from a platen.

In some embodiments, the polishing pad 12 is used in conjunction with a removal system that has engagement structure for engaging the polishing pad 12. One such removal system is shown in FIGS. 3*a*–3*b*, and comprises a removal roller 36 that is connected to a rotating device 38. In FIGS. 3*a*–3*b*, the removal system is shown interacting with the polishing pad 46.

The removal roller 36 may be any device adapted for holding the protuberance portion of a polishing pad. The preferred design of removal roller 36 depends upon the particular polishing pad to be removed, the CMP device being used, and the components of the CMP system being used. In FIGS. 3*a* and 3*b* the removal roller 36 has structure for attaching to the protuberance portion 68 of a polishing pad. The rotating device 38 may be any suitable mechanism for imparting rotation to the removal roller 36. In some embodiments, the rotating device 38 is a drive motor or a lever, and is preferably a drive motor.

During operation, the removal roller 36 attaches to the protuberance portion 68 of the polishing pad 46, and is rotated to separate the polishing pad 46 from the platen 16. Although a removal roller may be designed to rotate in either a clockwise or a counter-clockwise direction, in the preferred embodiment depicted by FIG. 3, the rotating device 38 rotates the removal roller 36 in a clockwise direction, so that polishing pad 46 is removed from the platen 16, beginning with the end of the polishing pad 46 that is closest to its protuberance portion. The polishing pad 46 can roll around the removal roller 36 as it is removed.

Alternatively, the removal system can comprise a plurality of removal rollers for separating a polishing pad from a platen. In this multiple removal roller embodiment, one or more rotating devices may be used to rotate each removal roller, and each removal roller can separate a different part of a polishing pad. A particularly preferred multiple removal roller embodiment comprises two removal rollers that simultaneously lift opposing portions of a polishing pad.

Figure 4A:
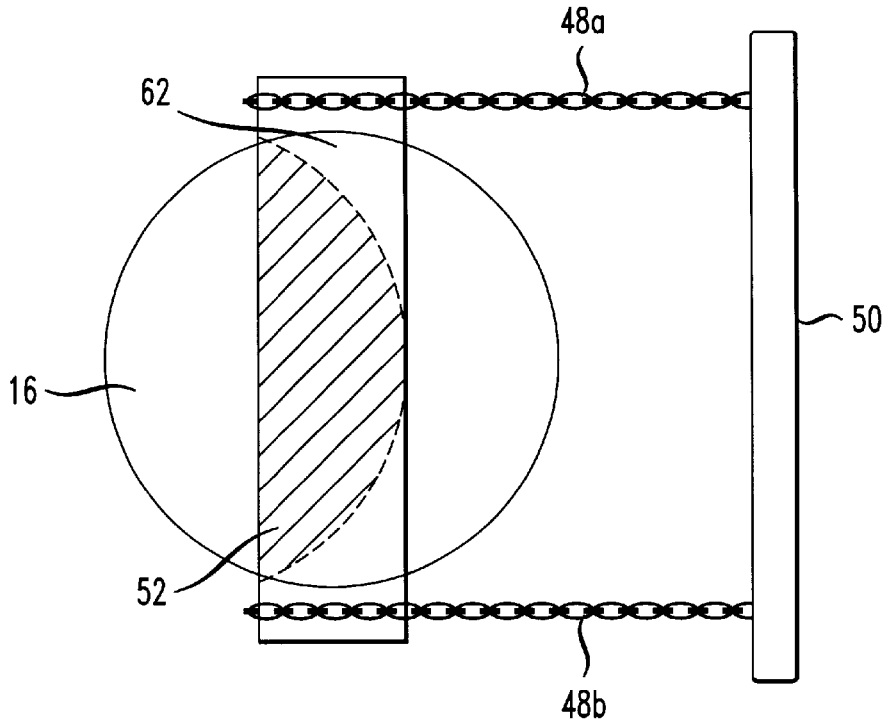
FIG. 4*a* is a top plan view of a chain system for removing a polishing pad from a platen.
Figure 4B:
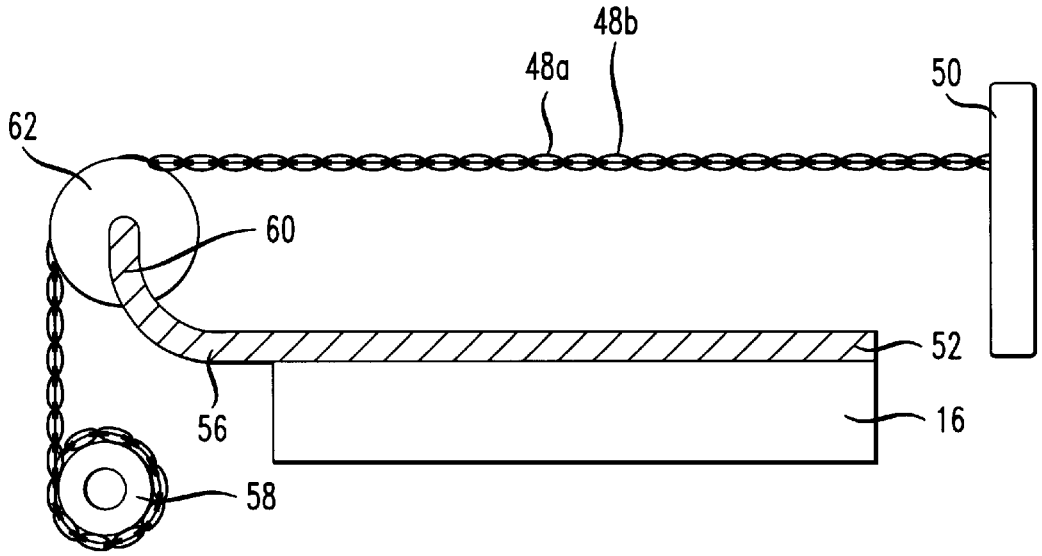
FIG. 4*b* is a schematic of a chain system for removing a polishing pad from a platen.

Another removal system that can be used in conjunction with the pad of the invention is a chain removal system that has engagement structure for engaging the protuberance portion of a polishing pad. One such chain removal system, as depicted in FIG. 4, has a first chain 48*a*, a second chain 48*b*, a removal roller 62, and a pulling device 50. Also shown in FIG. 4 is a polishing pad having a main portion 52 and a protuberance portion 56. The protuberance portion 56 is inserted into a removal roller slot 60 in the removal roller 62. In the chain removal system, pulling device 50 may be any device capable of generating the force necessary to pull the chains 48*a* and 48*b* so that the removal roller 62 rotates, such as a lever or a drive motor, and is preferably a drive motor.

The chain removal system can have an open loop chain or a closed loop chain. One embodiment of an open loop chain removal system is shown in FIG. 4, in which chains 48*a* and 48*b* are connected to the pulling device 50 and to the removal roller 62, and ends of chains 48*a* and 48*b* are wound onto chain spool 58. During operation, the rotating device 50 pulls the chains 48*a* and 48*b* across suitable structure such as gear teeth on the removal roller 62, imparting clockwise rotation to the removal roller 62. Using an open loop chain is advantageous because the portion of the chain that is wound on the chain spool can be stored on or within the CMP device when the removal device is not being used.

As depicted in FIG. 4, some preferred embodiments have a removal roller slot 60 in the removal roller 62. The protuberance portion 68 can be inserted into removal roller slot 60 and held into place by any device suitable for holding a polishing pad. The holding device may reversibly grasp, fasten, adhere, lock, or otherwise engage the protuberance portion 68.

Alternatively, a closed loop chain removal system can be used, in which a plurality of chains are connected to both a pulling device and a removal roller. During operation, the rotating device pulls the chains across suitable structure such as gear teeth on the rotating device and the removal roller, imparting clockwise rotation to the rotating device and the removal roller.

Figure 5A:
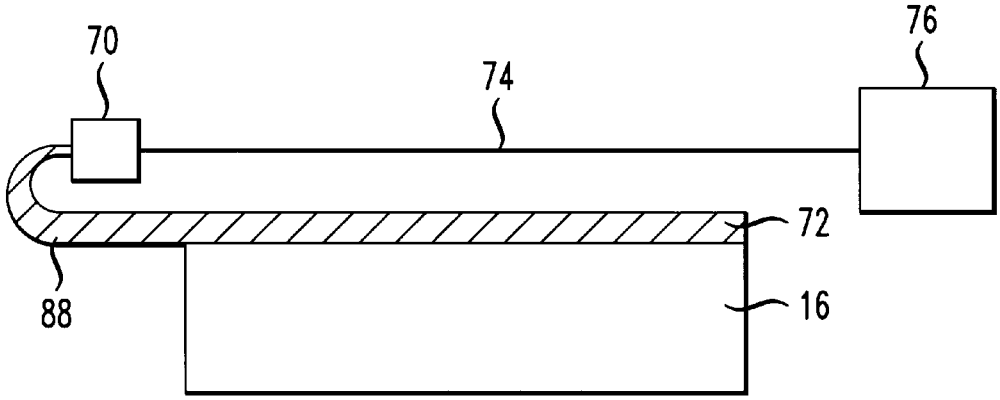
FIG. 5*a* is a schematic of a gear system for holding a polishing pad.
Figure 5B:
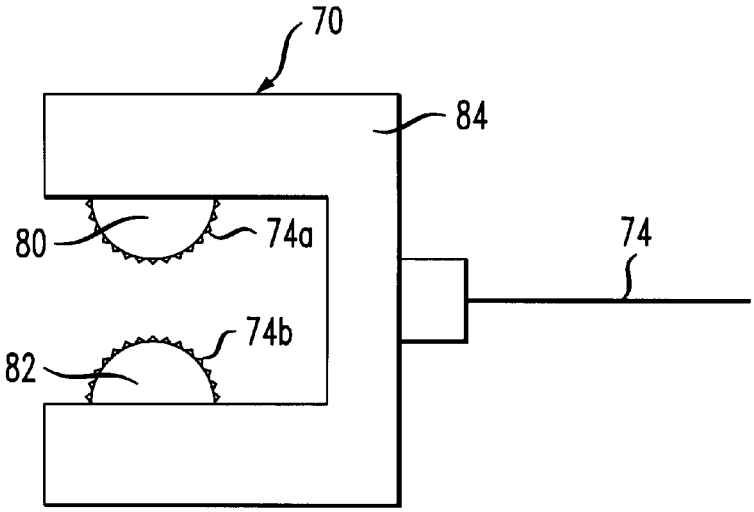
FIG. 5*b* is an exploded view of the holding mechanism of FIG. 5*a*.
Figure 5C:
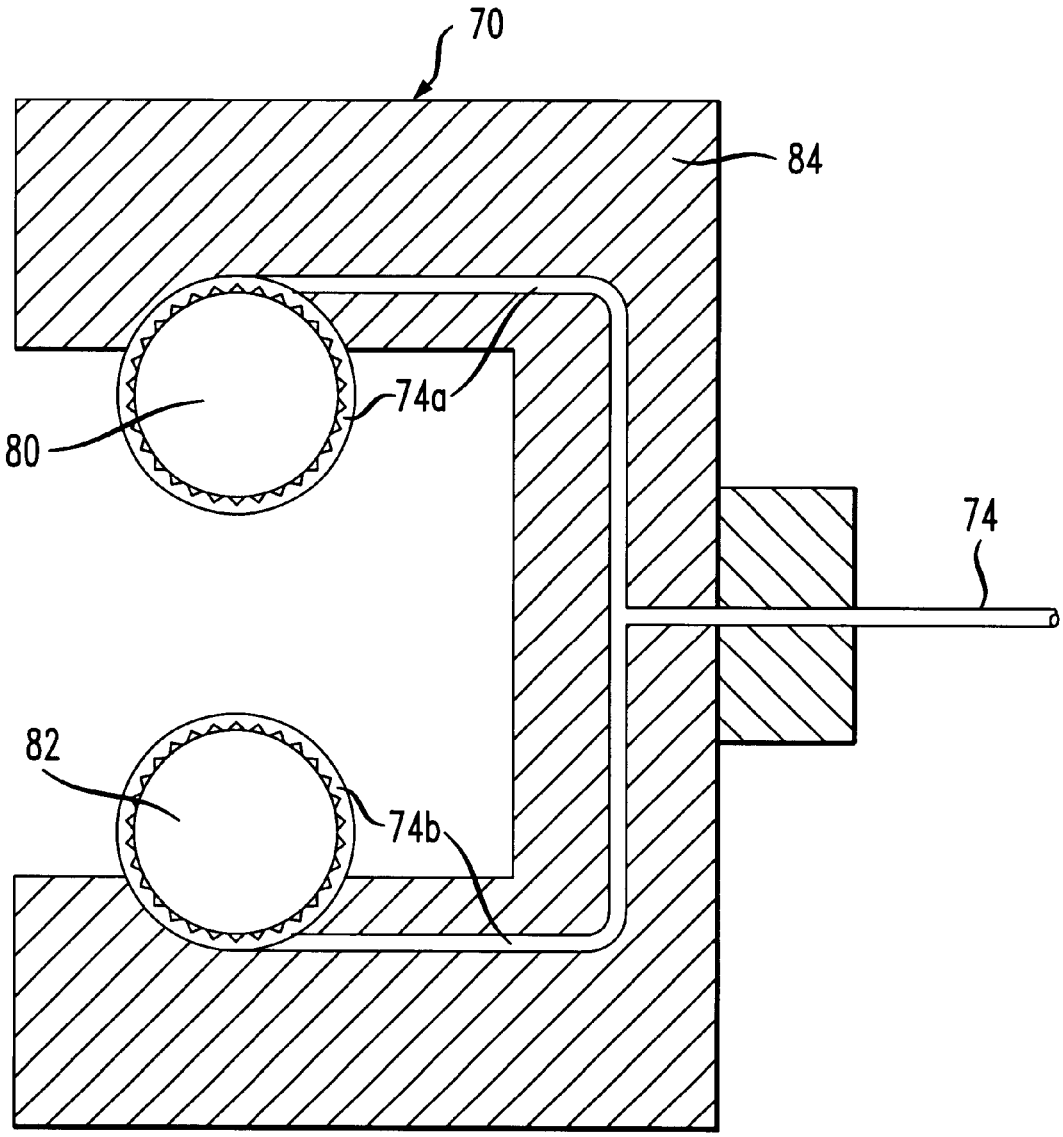
FIG. 5*c* is a cross-sectional view through the holding mechanism of FIG. 5*b*.

The removal system of FIGS. 5*a*–5*c* can also be used to remove a pad from a platen. This system comprises an engagement structure for grabbing a polishing pad automatically. One such engagement structure, as depicted in FIG. 5*a*, has a platen 16, a polishing pad 72, a pulling device 76, a connector 74, and a fastener 70. The polishing pad 72 is residing on the platen 16, and the protuberance portion 88 of the polishing pad 72 is connected to the fastener 70. The connector 74 attaches the fastener 70 to the pulling device 76 with any suitable device, such as a wire, cord, or cable. The pulling device 76 can be any suitable device for pulling the connector 74, such as a drive motor, and is preferably a winching tool. The pulling device 76 pulls the connector 74 which, in turn, pulls the fastener 70, causing the fastener 70 to engage the polishing pad 72 and separate it from the platen 16.

FIG. 5*b* is an exploded view of the fastener 70 which comprises a housing 84, a plurality of holding devices 80 and 82, and a plurality of split connectors 74*a* and 74*b*. A connector 74 is attached to the housing 84, and the plurality of holding devices 80 and 82 are partially contained within the housing 84. The holding devices 80 and 82 can be any suitable devices for holding the split connectors 74*a* and 74*b*, and can be any suitable devices for engaging the protuberance portion 88 of the polishing pad 72. In a preferred embodiment, the connectors 74*a* and 74*b* are cables, and the holding devices 80 and 82 are gears with teeth capable of automatically engaging the cables. The holding devices 80 and 82 and the split connectors 74*a* and 74*b* are more clearly depicted in FIG. 5*c*, which shows a cross-sectional view of the fastener 70.

When the protuberance portion 88 of the polishing pad 72 is attached to the fastener 70 and the pulling device 76 is activated, the connector 74 is pulled towards the pulling device 76. In the preferred embodiment of FIG. 5*b*, such movement of the connector 74 pulls the split connectors 74*a* and 74*b*, causing the holding devices 80 and 82 to rotate. Thus, the pulling device 76 pulls the cable 74 which, in turn, pulls the fastener 70 as it holds the protuberance portion 88 of the polishing pad 72, causing the polishing pad 72 to separate from the platen 16.

The holding devices 80 and 82 can also hold the protuberance portion 88 of the polishing pad 72 if they are attached to any suitable structure that pulls the holding devices 80 and 82 towards each other. Such suitable structure can be a spring structure that pulls holding devices 80 and 82 towards each other when the connector 74 is pulled.

Many other removal systems or machines are within the invention, and various configurations can be assembled by one of ordinary skill in the art. The preferred system or machine will depend upon the particular type of CMP device and polishing pad being used.

It should be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof.

What is claimed is:

1. A polishing pad removal system, comprising:

a polishing platen;

a polishing pad, removably coupled to said polishing platen, including:

a main polishing portion having an outer perimeter that substantially covers a semiconductor wafer polishing platen, and a protuberance portion coupled to and extending from said outer perimeter;

an engagement structure for engaging said protuberance portion wherein said engagement structure is a fastener having a plurality of holding devices and a plurality of split connectors that engage said holding devices, or a roller; and a pulling structure for pulling said engagement structure, whereby said polishing pad can be separated from said polishing platen.

2. The removal system of claim 1, wherein said polishing pad has a main portion and at least one protuberance portion.

3. The removal system of claim 2, wherein said protuberance portion attaches to engagement structure for engaging a polishing pad.

4. The removal system of claim 1, wherein said polishing pad has at least one protuberance portion which comprises engagement structure that engages a removal roller, whereby rotation of said removal roller causes said pad to separate from a platen.

5. The removal system of claim 4, wherein said removal roller has a slot, and wherein said at least one protuberance portion is inserted into said slot prior to rotation of said removal roller.

6. The removal system of claim 1, further comprising a chain that engages said engagement structure and is connected to said pulling structure.

7. The removal system of claim 6, wherein said engagement structure is a removal roller that is connected to said pulling structure, whereby pulling said chain across said removal roller rotates said removal roller and rotation of said removal roller causes said pad to separate from a platen.

8. The removal system of claim 7, wherein said engagement structure further comprises a removal roller, and rotation of said removal roller causes said split connectors to rotate said holding devices.

9. The removal system of claim 7, wherein said engagement structure further comprises a removal roller, and said pulling structure pulls said holding devices together so that said holding devices can hold said polishing pad.

10. A method for removing a polishing pad from a semiconductor wafer polishing platen, comprising:

providing a polishing pad, removably coupled to a polishing platen, including a main portion having an outer perimeter that substantially covers said polishing platen, and a protuberance portion connected to and extending from said outer perimeter;

engaging said protuberance portion with an engagement structure comprising a fastener having a plurality of holding devices and a plurality of split connectors for engaging said holding devices, or a roller; and pulling said engagement structure with a pulling structure, whereby said polishing pad is separated from said polishing platen.

11. The method of claim 10, wherein said at least one protuberance portion comprises engagement structure that engages a removal roller, whereby rotation of said removal roller by said rotating device causes said pad to separate from a platen.

12. The method of claim 11, wherein said removal roller has a slot, and wherein said at least one protuberance portion is inserted into said slot prior to said pulling step.

13. The method of claim 10 further comprising a chain that engages said engagement structure and is connected to said pulling structure.

14. The method of claim 13, wherein said engagement structure comprises a removal roller that is connected to said pulling structure, whereby pulling said chain across said removal roller rotates said removal roller, and rotation of said removal roller causes said pad to separate from said platen.

15. The method of claim 14, wherein said engagement structure further comprises a removal roller, and rotation of said removal roller causes said split connectors to rotate said holding devices.

16. The method of claim 14, wherein said engagement structure further comprises a removal roller, and said pulling structure pulls said holding devices together so that said holding devices can hold said polishing pad.

* * * * *